US010422137B2

(12) United States Patent
Kim et al.

(10) Patent No.: US 10,422,137 B2
(45) Date of Patent: Sep. 24, 2019

(54) HEAT SHRINKABLE TUBE-COVERED REBAR AND METHOD OF PREVENTING REBAR FROM CORRODING USING THE SAME

(71) Applicant: KOREA INSTITUTE OF CIVIL ENGINEERING AND BUILDING TECHNOLOGY, Gyeonggi-Do (KR)

(72) Inventors: Hyeong Yeol Kim, Gyeonggi-Do (KR); Ki Tae Park, Gyeonggi-Do (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 14 days.

(21) Appl. No.: 15/378,053

(22) Filed: Dec. 14, 2016

(65) Prior Publication Data

US 2018/0148931 A1 May 31, 2018

(30) Foreign Application Priority Data

Nov. 28, 2016 (KR) ..... 10-2016-0158979

(51) Int. Cl.

| | |
|---|---|
| ***E04C 5/07*** | (2006.01) |
| ***E04C 5/01*** | (2006.01) |
| ***E04B 1/64*** | (2006.01) |
| *E04C 5/06* | (2006.01) |

(52) U.S. Cl.

CPC ..... *E04C 5/015* (2013.01); *E04B 1/642* (2013.01); *E04C 5/06* (2013.01)

(58) Field of Classification Search

CPC ... E04C 5/07; E04C 5/165; E04C 5/01; C23F 2201/02; E04B 1/642

See application file for complete search history.

(56) References Cited

U.S. PATENT DOCUMENTS

| | | | | |
|---|---|---|---|---|
| 4,509,820 | A * | 4/1985 | Murata | G02B 6/2558 156/86 |
| 4,705,657 | A * | 11/1987 | Poulin | B29C 61/003 264/230 |
| 5,066,095 | A * | 11/1991 | Dekeyser | G02B 6/4428 385/100 |
| 5,843,266 | A | 12/1998 | Greenwood | |
| 9,624,667 | B2 * | 4/2017 | Gibson | E04C 5/07 |
| 2012/0328896 | A1 * | 12/2012 | Kar | E04C 5/03 428/544 |
| 2013/0180200 | A1 * | 7/2013 | Gavin | E04C 5/167 52/677 |
| 2014/0308081 | A1 * | 10/2014 | Clingan | E21D 21/008 405/259.5 |

FOREIGN PATENT DOCUMENTS

| | | |
|---|---|---|
| JP | U3119487 | 2/2006 |
| KR | 10-0482977 | 4/2005 |

* cited by examiner

*Primary Examiner* — Brian E Glessner
*Assistant Examiner* — Daniel J Kenny
(74) *Attorney, Agent, or Firm* — JCIPRNET

(57) ABSTRACT

A heat shrinkable tube-covered rebar basically solves a problem of corrosion of a rebar embedded in a concrete structure by covering the rebar with a heat shrinkable tube, which is a polymer material, and a thermosetting resin to prevent the rebar embedded in the concrete structure from corroding, and easily integrates a reinforcing bar with the heat shrinkable tube and perform a first anti-corrosion treatment on the reinforcing bar by applying a thermosetting resin between the reinforcing bar and the heat shrinkable tube.

3 Claims, 9 Drawing Sheets

[FIG. 1]
—Prior Art—
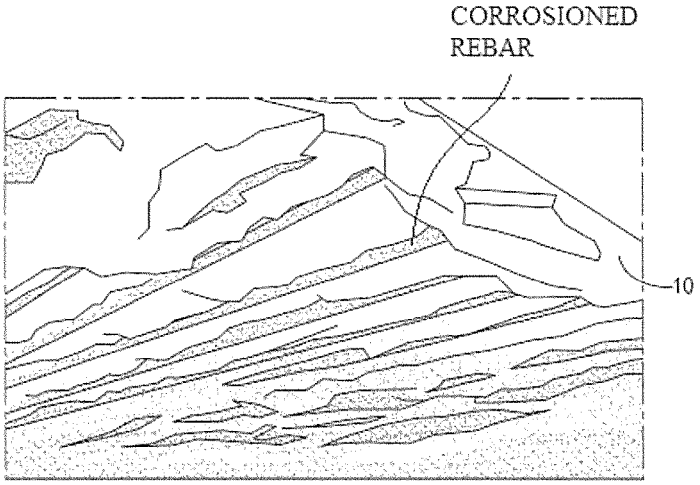
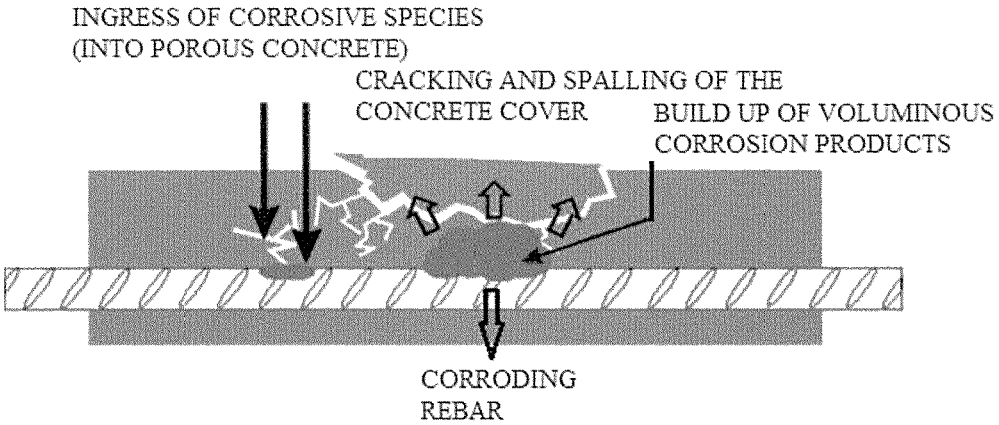

[FIG. 2]
—Prior Art—
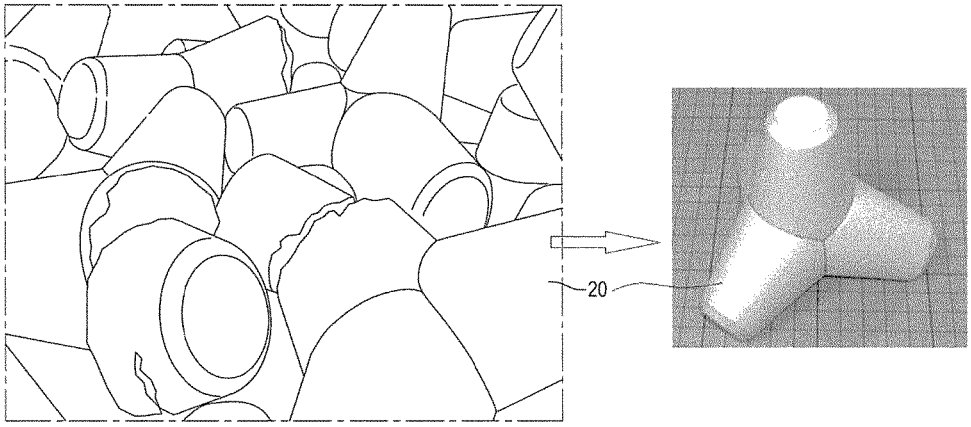
[FIG. 3]
—Prior Art—
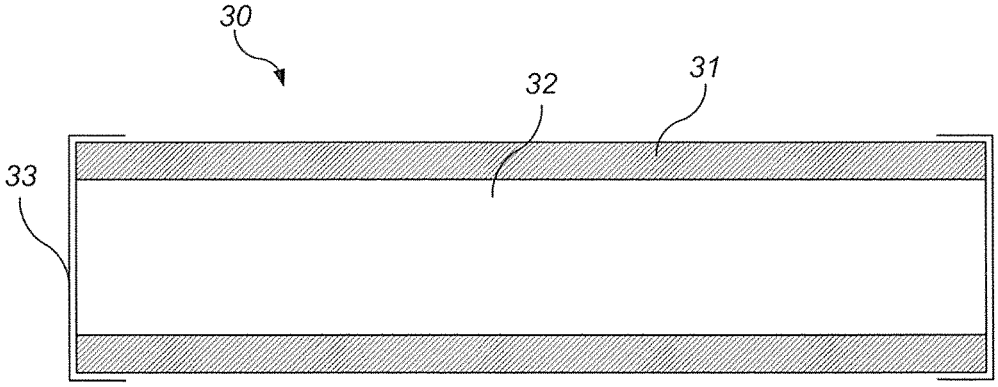

[FIG. 4A]
—Prior Art—
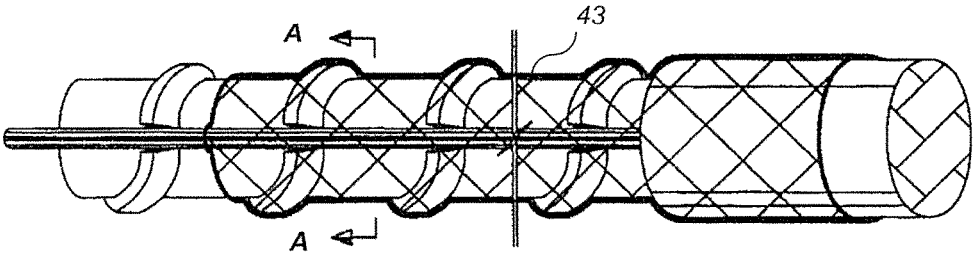
[FIG. 4B]
—Prior Art—
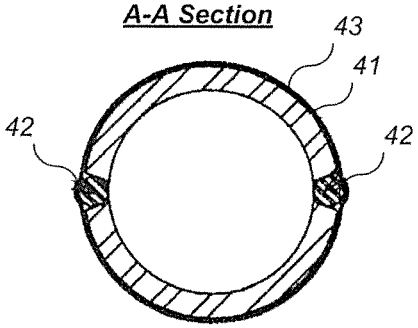

100
[FIG. 5A]
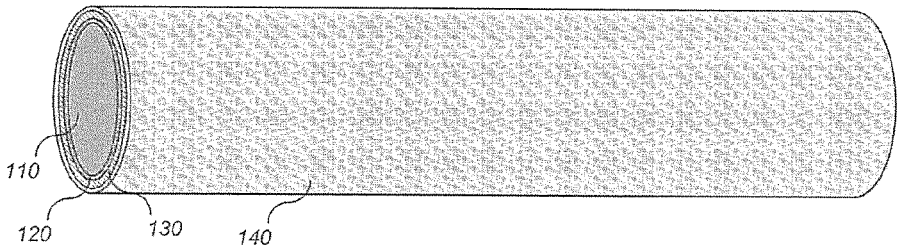
[FIG. 5B]
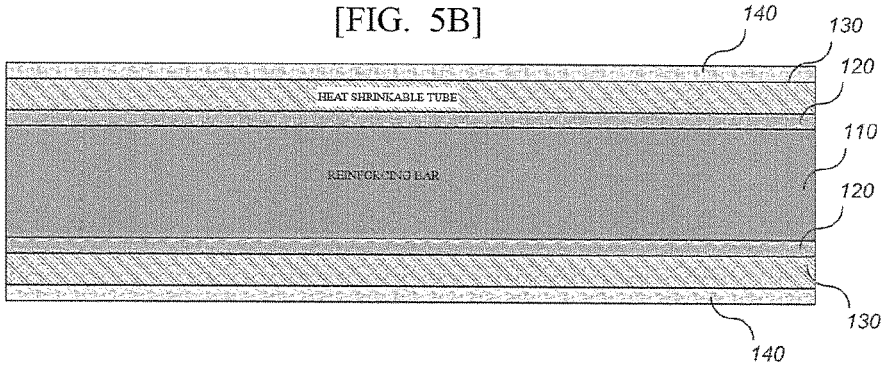
b)
[FIG. 6]
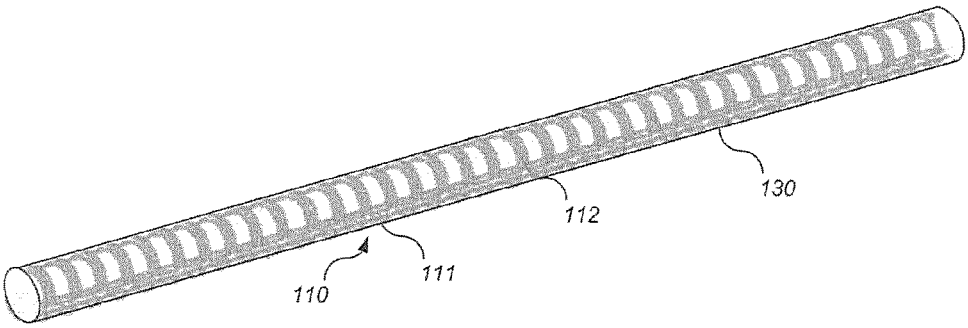

[FIG. 7]
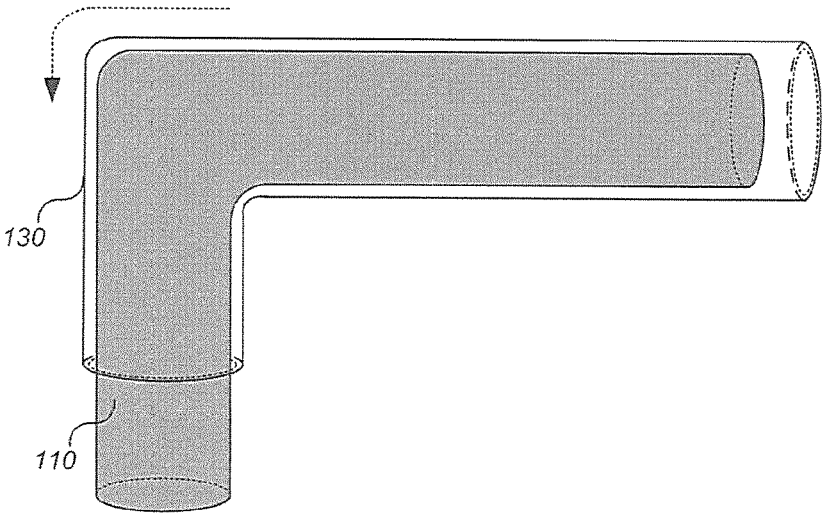
[FIG. 8]
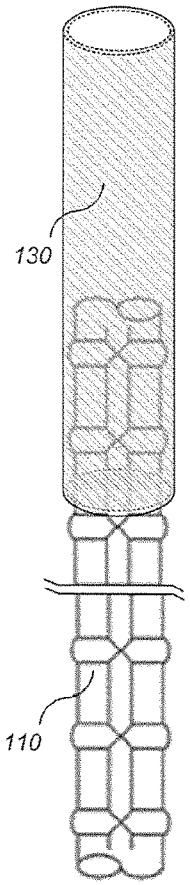

[FIG. 9A]
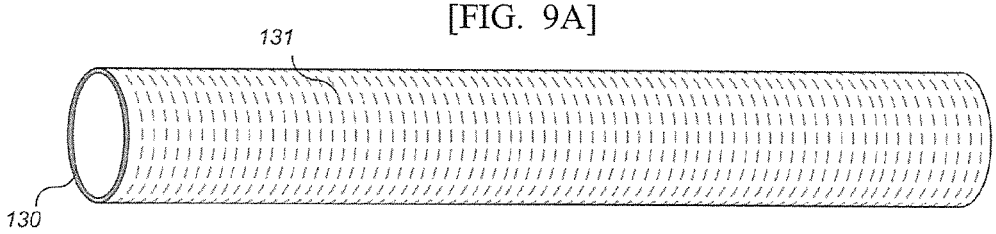
[FIG. 9B]
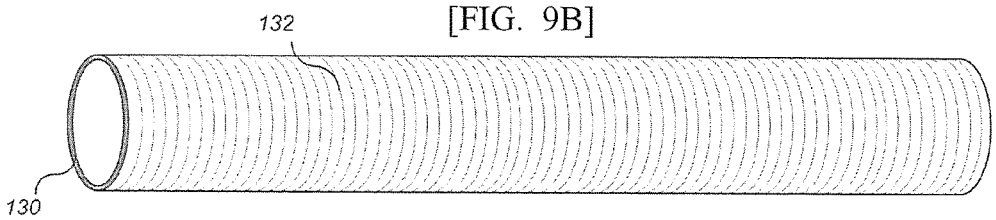
[FIG. 9C]
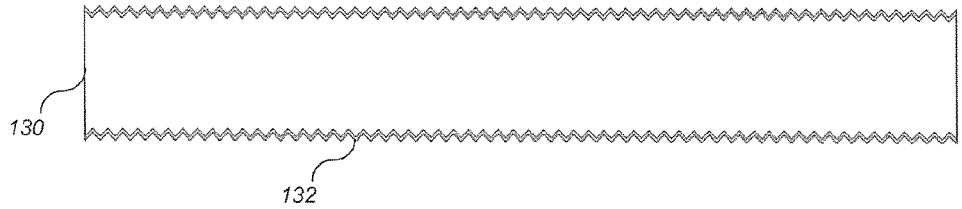
[FIG. 9D]
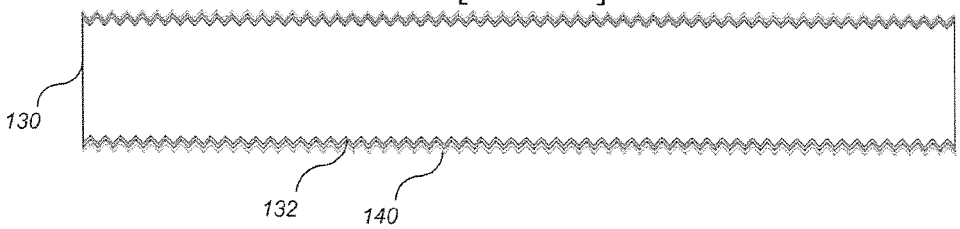

[FIG. 10]
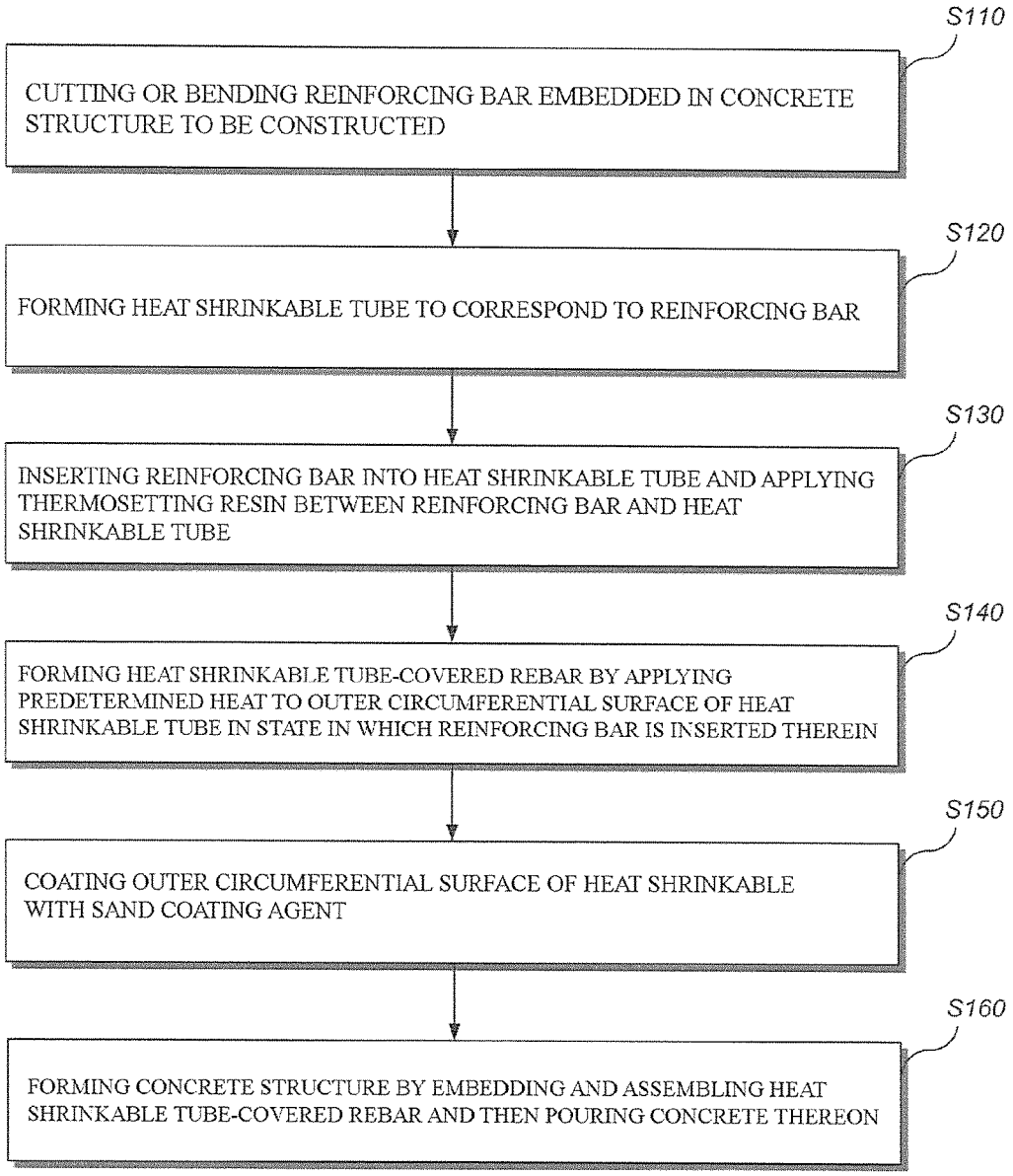

[FIG. 11A]
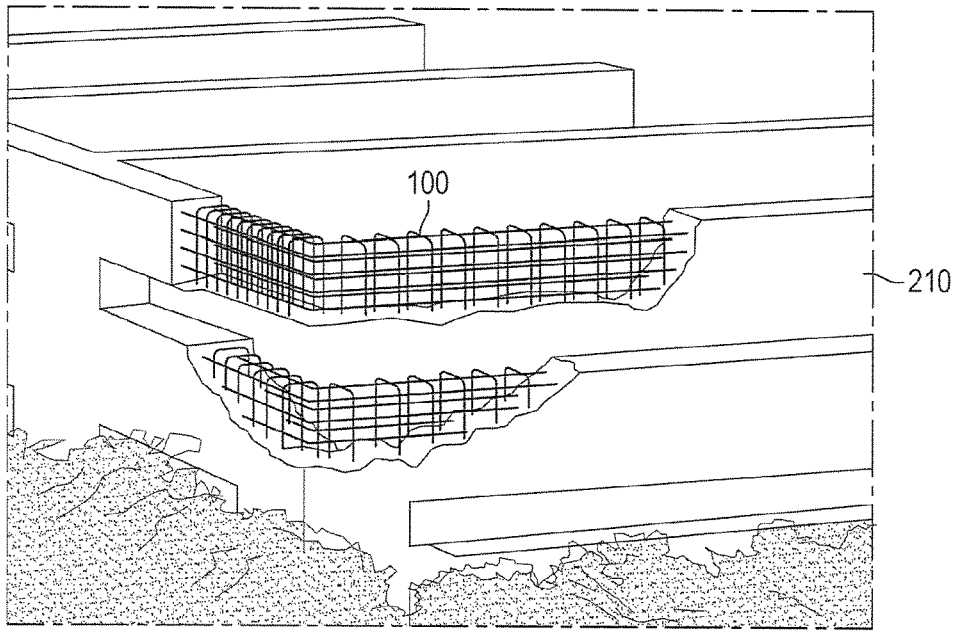
[FIG. 11B]
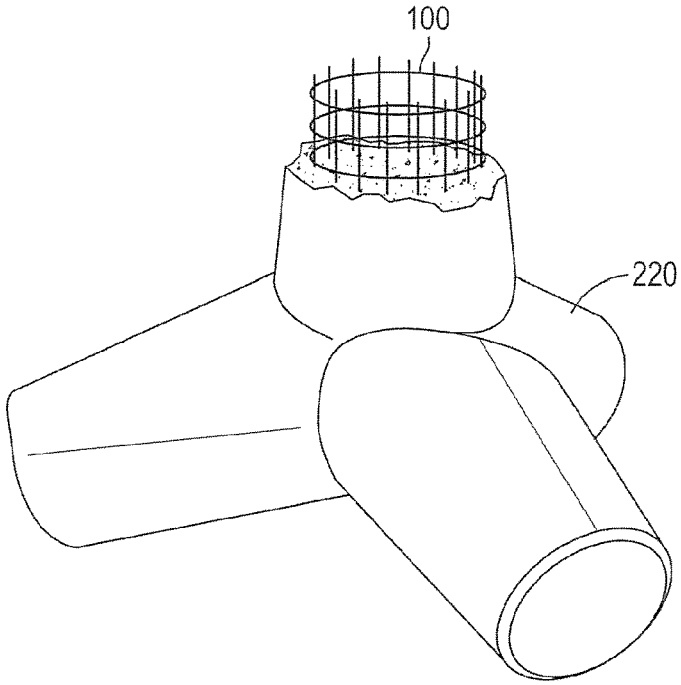

[FIG. 11C]
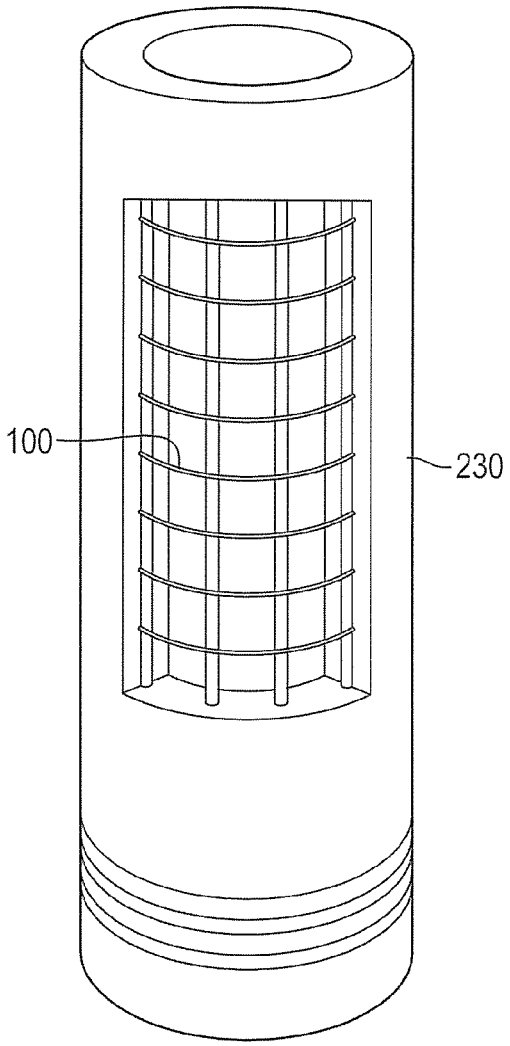

HEAT SHRINKABLE TUBE-COVERED REBAR AND METHOD OF PREVENTING REBAR FROM CORRODING USING THE SAME

CROSS-REFERENCE TO RELATED APPLICATION

This application claims priority to and the benefit of Korean Patent Application No. 10-2016-0158979, filed on Nov. 28, 2016, the disclosure of which is incorporated herein by reference in its entirety.

BACKGROUND

1. Field of the Invention

The present invention relates to a heat shrinkable tube-covered rebar, and more specifically, to a heat shrinkable tube-covered rebar which is covered with a heat shrinkable tube and a thermosetting resin in order for being embedded in a concrete structure, and a method of preventing a rebar from corroding using the same.

2. Discussion of Related Art

Generally, major infrastructure facilities are built of a reinforced concrete material which has excellent durability and constructability and is economical. However, the biggest disadvantage of a rebar is that, when the rebar is exposed to moisture or water, the durability of the facility may be degraded due to corrosion, or a structural accident may be caused due to partial loss of a cross-section when the facilities are in use.

FIG. 1 is a view illustrating a concrete structure 10 damaged and delaminated due to corrosion of a rebar according to a conventional art. When a rebar corrodes due to a rebar corrosion expansion pressure, the cross-section of rebar may expand 2.5 rebar, and thus the concrete structure 10 around the rebar may be damaged and delaminated.

Recently, as demand of an offshore concrete structure increases, a concrete structure in which a rebar is currently not used at all, such as a wave dissipating block (or a tetrapod) used for a breakwater, is constructed because a rebar is easily corroded in an offshore environment. As shown in FIG. 2, a concrete structure which is not reinforced by a rebar has a disadvantage in that it is easily damaged by external force such as wave and the like. FIG. 2 is a view illustrating a damaged state of a wave dissipating block 20 constructed without a rebar according to the conventional art.

A corrosion-resistant rebar is also used for a general onshore structure, such as a bridge and the like, that require high durability. Corrosion-resistant rebars are broadly classified into a completely non-corroding stainless steel rebar and a corrosion-resistant epoxy-coated rebar. The price of a stainless steel rebar is about five times greater than that of a general rebar. When a stainless steel rebar is used, the economic feasibility of a steel reinforcing concrete material is remarkably degraded, and thus use of the stainless steel rebar has been avoided.

Also, the corrosion-resistant rebar which currently has a competitive price in the market is an epoxy-coated rebar. In South Korea, a method of forming a film by spraying powder paint on an outer portion of a rebar heated in an electrical method is used as a method of forming an epoxy polymer film on an outer surface of a rebar. However, the film is easily delaminated when the rebar is handled. The method has a disadvantage in that the film is delaminated and partially peeled off when the rebar is bent at a construction site, and thus the method has been used restrictively.

A heat shrinkable tube is for coating a wire or a cable to protect the wire or a cable covering an electric wire. When the heat shrinkable tube is heated, a cross-section of the heat shrinkable tube is formed in a circular shape. That is, before the heat shrinkable tube is formed, the heat shrinkable tube does not have a specific shape and has a large diameter. When the heat shrinkable tube is heated, the heat shrinkable tube is shrunk and adheres to a circumferential surface of an electric wire.

In this case, when a heat shrinkable tube is thermally formed, a worker inserts an electric wire into the heat shrinkable tube at a work site and then heats the heat shrinkable tube using a separate heating tool such as a lighter, a burner, and the like, thereby forming the heat shrinkable tube.

As a prior art, a title of "Heat Shrinkable Tube-Covered Rebar" is disclosed in Japanese Registered Utility Patent No. 3119487 and will be described with reference to FIG. 3.

FIG. 3 is a view illustrating a heat shrinkable tube-covered rebar according to a conventional art.

Referring to FIG. 3, a heat shrinkable tube-covered rebar 30 according to the conventional art includes a heat shrinkable tube 31, a rebar 32, and a cap heat shrinkable tube 33. The heat shrinkable tube 31 is shrunk in a temporary cylindrical heating device with a heat source mounted therein by receiving heat, and thus the heat shrinkable tube 31 and the rebar 32 are integrally adhered to each other to form the heat shrinkable tube-covered rebar.

However, the heat shrinkable tube-covered rebar 30 according to the conventional art, which has a deformed bar as the rebar 32, has a problem in that adhesion between the heat shrinkable tube 31 and the rebar 32 is difficult.

As another prior art, "Removable Soil-Nail Using Screw Type Rebar And Manufacturing Method" is disclosed in Korean Registered Patent No. 10-482977 and will be described with reference with FIGS. 4A-4B.

FIGS. 4A-4B show views illustrating a shape of a screw type rebar shrunk after a heat shrinkable tube is shrunk on a removable nail using the screw type rebar according to the conventional art. FIG. 4A is a perspective view of the screw type rebar, and FIG. 4B is a cross-sectional view taken along line A-A shown in FIG. 4A.

As shown in FIGS. 4A-4B, the removable nail using the screw type rebar according to the conventional art uses a spacer steel wire 42 maintaining a predetermined space when a heat shrinkable tube 43 for covering a screw type rebar 41 is shrunk, and also uses an end cap closing an end of one side of the screw type rebar 41.

According to the removable nail using a screw type rebar according to the conventional art, a screw type rebar without a rib is inserted into a heat shrinkable tube, the heat shrinkable tube is shrunk, and then the heat shrinkable tube adheres to a surface of the screw type rebar, thereby transmitting force without being directly attached to grout and retrieving the screw type rebar by rotating.

However, in the case of a heat shrinkable tube used in the removable nail using the screw type rebar according to the conventional art, there is a problem in that adhesion between the heat shrinkable tube and the rebar like the heat shrinkable tube-covered rebar according to the above-described conventional art is difficult.

SUMMARY OF THE INVENTION

The present invention is directed to a heat shrinkable tube-covered rebar which is covered with a heat shrinkable tube, which is formed of a polymer material, and a thermosetting resin in order for being embedded in a concrete structure, and a method of preventing a rebar from corroding using the same.

The present invention is also directed to a heat shrinkable tube-covered rebar capable of easily integrating a rebar with a heat shrinkable tube while preforming a first anti-corrosion treatment on the rebar by applying a thermosetting resin between the rebar and the heat shrinkable tube, and a method of preventing a rebar from corroding using the same.

The present invention is also directed to a heat shrinkable tube-covered rebar capable of increasing friction or adhesion by forming a protrusion or a wrinkle on an outer circumferential surface of a heat shrinkable tube, and a method of preventing a rebar from corroding using the same.

The present invention is also directed to a heat shrinkable tube-covered rebar capable of chemical adhesion with a concrete structure by applying a sand coating agent to an outer circumferential surface of a rebar covered with a heat shrinkable tube, and a method of preventing a rebar from corroding using the same.

According to an aspect of the present invention, there is provided a heat shrinkable tube-covered rebar including a reinforcing bar embedded in a concrete structure to reinforce the concrete structure, a heat shrinkable tube, which is a hollow tube into which the reinforcing bar is inserted, adhered to the reinforcing bar by heat being applied thereto in a state in which the reinforcing bar is inserted therein to function as a coat to prevent the reinforcing bar from corroding, a thermosetting resin coated on the reinforcing bar or coated on an inside of the heat shrinkable tube to prevent corrosion of the reinforcing bar, and a sand coating agent coated on an outer circumferential surface of the heat shrinkable tube to increase chemical adhesion with the concrete structure. The reinforcing bar covered with the heat shrinkable tube is embedded in the concrete structure.

The heat shrinkable tube may be made of polymeric polyolefin, poly vinyl chloride (PVC), or polyester, and the heat shrinkable tube may be adhered to the reinforcing bar by heat at a temperature of less than or equal to 100° C. being applied to the outer circumferential surface of the heat shrinkable tube to form a film thereon.

The heat shrinkable tube may have a protrusion or a wrinkle preformed on the outer circumferential surface (an outer surface) thereof or may have the sand coating agent pre-coated on the outer circumferential surface thereof to increase friction or adhesion.

The reinforcing bar may be a deformed bar having a rib and a node, and may have a film of the heat shrinkable tube thinly formed thereon to maintain shapes of the rib and the node on the deformed bar to maintain mechanical adhesion.

The thermosetting resin may be coated on an outer circumferential surface of the reinforcing bar or may be coated on the inside of the heat shrinkable tube to perform a first anti-corrosion treatment on the reinforcing bar. The reinforcing bar and the heat shrinkable tube may be integrated after the thermosetting resin is cured.

When the reinforcing bar is bent, the thermosetting resin may be coated on the outer circumferential surface of the reinforcing bar, and then the reinforcing bar may be inserted into the heat shrinkable tube.

The concrete structure may include a breakwater, a wave dissipating block, or a concrete pile.

According to another aspect of the present invention, there is provided a method of preventing a rebar from corroding using a heat shrinkable tube-covered rebar including a) cutting or bending a rebar embedded in a concrete structure to be constructed, b) forming a heat shrinkable tube to correspond to the reinforcing bar, c) inserting the reinforcing bar into the heat shrinkable tube and coating a thermosetting resin between the reinforcing bar and the heat shrinkable tube, d) forming a heat shrinkable tube-covered rebar by applying predetermined heat to an outer circumferential surface of the heat shrinkable tube in a state in which the rebar is inserted therein, e) coating the outer circumferential surface of the heat shrinkable tube with a sand coating agent to increase chemical adhesion with the concrete structure to be constructed, and f) embedding and assembling the heat shrinkable tube-covered rebar and then forming concrete structures by pouring concrete thereon.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a view illustrating a concrete structure damaged and detached due to corrosion of a rebar according to a conventional art;

FIG. 2 is a view illustrating a damaged state of a wave dissipating block constructed without a rebar according to a conventional art;

FIG. 3 is a view illustrating a heat shrinkable tube-covered rebar according to a conventional art;

FIGS. 4A to 4B show views illustrating a shape of a screw type rebar after a heat shrinkable tube is shrunk in a removable nail using a screw type rebar according to a conventional art;

FIGS. 5A to 5B show views illustrating a heat shrinkable tube-covered rebar according to an embodiment of the present invention;

FIG. 6 is a view illustrating a state of a deformed bar covered with a heat shrinkable tube in the heat shrinkable tube-covered rebar according to the embodiment of the present invention;

FIG. 7 is a view illustrating a bent reinforcing bar inserted into a heat shrinkable tube in the heat shrinkable tube-covered rebar according to the embodiment of the present invention;

FIG. 8 is a view illustrating a cut reinforcing bar inserted into a heat shrinkable tube in the heat shrinkable tube-covered rebar according to the embodiment of the present invention;

FIGS. 9A to 9D shows views illustrating formation of various heat shrinkable tubes which are applied to the heat shrinkable tube-covered rebar according to the embodiment of the present invention;

FIG. 10 is an operational flowchart of a method of preventing a rebar from corroding using the heat shrinkable tube-covered rebar according to the embodiment of the present invention; and FIGS. 11A to 11C are views illustrating a concrete structure with the heat shrinkable tube-covered rebar according to the embodiment of the present invention.

DETAILED DESCRIPTION OF EXEMPLARY EMBODIMENTS

Hereinafter, embodiments that are easily performed by those skilled in the art will be described in detail with reference to the accompanying drawings. However, embodiments of the present invention may be implemented in several different forms, and are not limited to the embodiments described herein. In addition, parts irrelevant to description are omitted in the drawings in order to clearly explain the embodiments of the present invention. Similar parts are denoted by similar reference numerals throughout this specification.

Throughout this specification, when a certain part "includes" a certain component, another component may be further included rather than excluding the other component unless otherwise defined.

[Heat Shrinkable Tube-Covered Rebar 100]

FIGS. 5A to 5B show views illustrating a heat shrinkable tube-covered rebar according to an embodiment of the present invention. FIG. 5A is a perspective view of the heat shrinkable tube-covered rebar, and FIG. 5B is a vertical cross-sectional view of the heat shrinkable tube-covered rebar.

Referring to FIGS. 5A to 5B, the heat shrinkable tube-covered rebar 100 includes a reinforcing bar 110, a thermosetting resin 120, a heat shrinkable tube 130, and a sand coating agent 140.

The reinforcing bar 110 is embedded in a concrete structure to reinforce the concrete structure. In this case, it is preferable that a general deformed bar be used as the reinforcing bar 110.

The heat shrinkable tube 130, which is a hollow tube into which the reinforcing bar 110 is inserted, is adhered to the reinforcing bar 110 by heat being applied to the heat shrinkable tube 130 in a state in which the reinforcing bar 110 is inserted therein to function as a coating to prevent corrosion of the reinforcing bar 110.

In this case, the heat shrinkable tube 130 may be made of polymeric polyolefin, poly vinyl chloride (PVC), and polyester. The heat shrinkable tube 130 is currently used in various industrial fields by being commercialized and manufactured with various thicknesses, sizes, and materials domestically and abroad. The heat shrinkable tube-covered rebar 100 according to the embodiment of the present invention is formed by inserting the reinforcing bar 110 with a typical size into the heat shrinkable tube 130 and causing the heat shrinkable tube 130 to adhere to and cover the reinforcing bar 110, for example, by applying heat at a temperature of less than or equal to 100° C. In this case, the heat shrinkable tube 130 has a memory effect in which the heat shrinkable tube 130 purposely stretched by applying force thereto is returned to an original position thereof when the temperature increases in the event of a process, and thus the heat shrinkable tube 130 to be used may have an inner diameter sufficient for insertion of the reinforcing bar 110 using the effect.

The thermosetting resin 120 is applied to the reinforcing bar 110 or is applied to the inside of the heat shrinkable tube 130 to prevent corrosion of the reinforcing bar 110. Specifically, the thermosetting resin 120 is applied to an outer circumferential surface of the reinforcing bar 110 or is applied to the inside of the heat shrinkable tube 130 to perform a first anti-corrosion treatment on the reinforcing bar 110. The thermosetting resin 120 may allow the heat shrinkable tube 130 and the reinforcing bar 110 to be integrated after the thermosetting resin 120 is cured.

The sand coating agent 140 is applied to an outer circumferential surface of the heat shrinkable tube 130 to increase chemical adhesion with a concrete structure. That is, in the case of the heat shrinkable tube-covered rebar 100 according to the embodiment of the present invention, the chemical adhesion with the concrete structure is decreased by the heat shrinkable tube, and thus it is preferable that the chemical adhesion with the concrete structure be increased using the sand coating agent 140.

Therefore, a concrete structure is constructed by embedding the heat shrinkable tube-covered rebar 100 according to the embodiment of the present invention therein. The thermosetting resin 120 and the heat shrinkable tube 130 block water from coming into contact with the reinforcing bar 110.

However, FIG. 6 is a view illustrating a state of a deformed bar covered with a heat shrinkable tube in the heat shrinkable tube-covered rebar according to the embodiment of the present invention, FIG. 7 is a view illustrating a bent reinforcing bar inserted into a heat shrinkable tube in the heat shrinkable tube-covered rebar according to the embodiment of the present invention, and FIG. 8 is a view illustrating a cut reinforcing bar inserted into a heat shrinkable tube in the heat shrinkable tube-covered rebar according to the embodiment of the present invention.

In the heat shrinkable tube-covered rebar 100 according to the embodiment of the present invention, as shown in FIG. 6, a deformed bar having a rib 111 and a node 112 may be covered with the heat shrinkable tube 130. The rib 111 and the node 112 at an outer circumferential surface of rebar are formed at a deformed bar that is widely used as a stiffening member of reinforced concrete.

In this case, since a film of the heat shrinkable tube 130 is very thin, the rib 111 and the node 112 formed on an existing deformed bar to facilitate mechanical adhesion between the deformed bar and concrete may be maintained as they are even after the film of the heat shrinkable tube is formed, and thus the mechanical adhesion is substantially the same as that of the existing deformed bar. However, the chemical adhesion may be lower than that of an existing reinforcing bar due to the heat shrinkable tube 130, and the sand coating agent 140 may be coated on an outer portion of the heat shrinkable tube 130 when necessary.

In the heat shrinkable tube-covered rebar according to the embodiment of the present invention, as shown in FIGS. 7 and 8, the reinforcing bar 110 is bent depending on a required structure and then is inserted into the heat shrinkable tube 130. In this case, a large heat shrinkable tube with a large inner diameter may be used so that the heat shrinkable tube 130 easily passes through the bent portion. A shrinkage factor of the currently manufactured heat shrinkable tube 130 may generally be 50% of an inner diameter of the exiting heat shrinkable tube.

However, FIGS. 9A to 9D show views illustrating formation of various heat shrinkable tubes which are applied to the heat shrinkable tube-covered rebar according to the embodiment of the present invention.

The heat shrinkable tube 130 which is applied to the heat shrinkable tube-covered rebar according to the embodiment of the present invention, as shown in FIG. 9A, may have protrusions 131 formed on an outer circumferential surface (an outer surface) thereof to increase adhesion or friction when the heat shrinkable tube 130 is manufactured, or, as shown in FIGS. 9B and 9C, may have wrinkles 132 preformed thereon. Also, as shown in FIG. 9D, the protrusions or the wrinkles formed on the outer circumferential surface of the heat shrinkable tube 130 may be pre-coated with the sand coating agent 140.

According to the heat shrinkable tube-covered rebar according to the embodiment of the present invention, a price of the heat shrinkable tube is low so that construction costs are hardly affected. Construction of the heat shrinkable tube is conveniently performed so that the heat shrinkable tube may be conveniently applied even after or before arranging rebars.

[Method of Preventing a Heat Shrinkable Tube-Covered Rebar from Corroding]

FIG. 10 is an operational flowchart of a method of preventing a rebar from corroding using the heat shrinkable tube-covered rebar according to the embodiment of the present invention.

Referring to FIG. 10, the method of preventing a heat shrinkable tube-covered rebar from corroding according to the embodiment of the present invention will be described below. First, the reinforcing bar 110 to be embedded in a concrete structure to be constructed is processed to be cut or bent (S110).

Next, the heat shrinkable tube 130 is formed to correspond to the reinforcing bar 110 (S120). The heat shrinkable tube 130 is made of polymeric polyolefin, PVC, or polyester. The heat shrinkable tube 130 is adhered to the reinforcing bar 110 by heat being applied to an outer circumferential surface of the heat shrinkable tube 130 at a temperature of less than or equal to 100° C. to form a film thereon. The reinforcing bar 110 is a deformed bar having the rib 111 and the node 112, and the film of the heat shrinkable tube 130 is formed to be thin so that a shape of the rib 111 and the node 112 formed on the deformed bar is maintained and mechanical adhesion may be maintained.

The reinforcing bar 110 is inserted into the heat shrinkable tube 130, and the thermosetting resin 120 is applied between the reinforcing bar 110 and the heat shrinkable tube 130 (S130). In this case, the thermosetting resin 120 is applied to an outer circumferential surface of the reinforcing bar 110 or the inside of the heat shrinkable tube 130 to perform the first anti-corrosion treatment on the reinforcing bar 110. After the thermosetting resin 120 is cured, the reinforcing bar 110 and the heat shrinkable tube 130 may be integrated. For example, it is preferable that the thermosetting resin 120 be applied to the outer circumferential surface of the reinforcing bar 110 when the reinforcing bar 110 is bent, and then the reinforcing bar 110 be inserted into the heat shrinkable tube 130.

Next, the heat shrinkable tube-covered rebar 100 is formed by applying predetermined heat to the outer circumferential surface of the heat shrinkable tube 130 in a state in which the reinforcing bar 110 is inserted therein (S140).

The sand coating agent 140 is coated on the outer circumferential surface of the heat shrinkable tube 130 to increase chemical adhesion with a concrete structure to be constructed (S150).

The concrete structure is formed by embedding and assembling the heat shrinkable tube-covered rebar 100 and pouring concrete (S160). In this case, the concrete structure may be not only a bridge structure, a tunnel structure, and a building structure, but also an offshore structure such as a breakwater 210, a wave dissipating block 220, a concrete pile 230, or the like, but the present invention is not limited thereto.

The heat shrinkable tube-covered rebar according to the embodiment of the present invention can basically solve a problem of corrosion of a rebar embedded in a concrete structure by covering the rebar with a heat shrinkable tube, which is a polymer material, and a thermosetting resin to prevent the rebar embedded in the concrete structure from corroding, can easily integrate the rebar with the heat shrinkable tube and perform the first anti-corrosion treatment on the rebar by applying a thermosetting resin between the rebar and the heat shrinkable tube, can increase friction or adhesion by forming protrusions or wrinkles on an outer circumferential surface of the heat shrinkable tube, and can increase mechanical adhesion with the concrete structure by applying a sand coating agent to an outer circumferential surface of the rebar covered with the heat shrinkable tube.

[Concrete Structure 200 with a Heat Shrinkable Tube-Covered Rebar]

FIGS. 11A to 11C are views illustrating the heat shrinkable tube-covered rebar according to the embodiment of the present invention.

A concrete structure with the heat shrinkable tube-covered rebar according to the embodiment of the present invention may be the breakwater 210 as shown in FIG. 11A, and may be the wave dissipating block 220 shown in FIG. 11B. As shown in FIG. 11C, a concrete structure with the heat shrinkable tube-covered rebar may be the concrete pile 230, but the present invention is not limited thereto.

Generally, as shown in FIG. 11A, the breakwater 210 does not use a reinforcing bar or is constructed with a large coating thickness to reduce the possibility of corrosion when a reinforcing bar is used, and thus construction costs are increased. When the heat shrinkable tube-covered rebar 100 according to the embodiment of the present invention is applied to the breakwater 210, the concrete structure has increased strength so that safety and durability are increased and the concrete structure is easily maintained and managed. Also, since the coating thickness of the heat shrinkable tube-covered rebar 100 is the same as when a general corrosion-resistant rebar is used, construction costs are reduced.

Also, the heat shrinkable tube-covered rebar 100 according to the embodiment of the present invention may be applied when the wave dissipating block 220 shown in FIG. 11B or the concrete pile 230 shown in FIG. 11C is manufactured and constructed, and can remarkably increase safety and durability of a concrete block as described above.

According to the present invention, the heat shrinkable tube-covered rebar can basically solve a problem of corrosion of a rebar embedded in a concrete structure by covering the rebar with a heat shrinkable tube, which is a polymer material, and a thermosetting resin to prevent the rebar embedded in the concrete structure from corroding, and can easily integrate the rebar with the heat shrinkable tube and perform a first anti-corrosion treatment on the rebar by applying a thermosetting resin between the rebar and the heat shrinkable tube.

According to the present invention, the heat shrinkable tube-covered rebar can easily integrate a reinforcing bar with a heat shrinkable tube while performing a first anti-corrosion treatment on the reinforcing bar by applying a thermosetting resin between the reinforcing bar and the heat shrinkable tube.

According to the present invention, the heat shrinkable tube-covered rebar can increase friction or adhesion by forming protrusions or wrinkles on an outer circumferential surface of a heat shrinkable tube, According to the present invention, the heat shrinkable tube-covered rebar can increase mechanical adhesion with a concrete structure by applying a sand coating agent to an outer circumferential surface of a rebar covered with a heat shrinkable tube.

The above description of the invention is only exemplary, and those skilled in the art should understand that various modifications can be made without departing from the scope of the present invention and without changing essential features thereof. Therefore, the above-described embodiments should be considered in a descriptive sense only and not for purposes of limitation. For example, each component described as a single type may be realized in a distributed manner, and similarly, components that are described as being distributed may be realized in a coupled manner.

The scope of the present invention is defined not by the detailed description but by the appended claims, and encompasses all modifications or alterations derived from meanings and the scope of the claims as well as equivalents thereof.

DESCRIPTION OF SYMBOLS

100: HEAT SHRINKABLE TUBE-COVERED REBAR
110: REINFORCING BAR
120: THERMOSETTING RESIN
130: HEAT SHRINKABLE TUBE
131: PROTRUSION
132: WRINKLE
140: SAND COATING AGENT
210: FIRST CONCRETE STRUCTURE/BREAKWATER
220: SECOND CONCRETE STRUCTURE/TETRAPOD
230: THIRD CONCRETE STRUCTURE/CONCRETE PILE

What is claimed is:

1. A system of a heat shrinkable tube-covered rebar embedded in a concrete structure, the system comprising:

a reinforcing bar;

a heat shrinkable tube, which is a hollow tube into which the reinforcing bar is inserted, having an inside wall coated with a thermosetting resin adhered to the reinforcing bar by heat being applied thereto in a state in which the reinforcing bar is inserted therein to function as a film preventing the reinforcing bar from corroding, wherein a heat shrinkable tube shrinks up to half of the inner diameter of the heat shrinkable tube with the application of heat; and a sand coating agent coated on an outer circumferential surface of the heat shrinkable tube to increase chemical adhesion with the concrete structure, wherein the reinforcing bar covered with the heat shrinkable tube is embedded in the concrete structure, wherein the outer circumferential surface of the heat shrinkable tube comprises a plurality of protrusions or a plurality of wrinkles, each of the protrusions or wrinkles is circularly pre-formed around an axis of the heat shrinkable tube and distributed in an axial direction of the heat shrinkable tube with a predetermined interval, so as to increase the adhesion and friction with the concrete structure, wherein the heat shrinkable tube is made of polymeric polyolefin, poly vinyl chloride (PVC), or polyester, and the heat shrinkable tube is adhered to the reinforcing bar by heat at a temperature of less than or equal to 100° C. being applied to the outer circumferential surface of the heat shrinkable tube to form a film thereon.

2. The system of the heat shrinkable tube-covered rebar of claim 1, wherein the reinforcing bar is a deformed bar having a rib and a node, and has a film of the heat shrinkable tube thinly formed thereon to maintain shapes of the rib and the node on the deformed bar to maintain mechanical adhesion.

3. The system of the heat shrinkable tube-covered rebar of claim 1, wherein the concrete structure includes a breakwater, a wave dissipating block, or a concrete pile.

* * * * *